US006641107B1

(12) United States Patent
Janssen

(10) Patent No.: US 6,641,107 B1
(45) Date of Patent: Nov. 4, 2003

(54) TOOL-FREE HANGING DEVICE

(76) Inventor: Peter G. Janssen, 1820 Spring Rose Rd., Verona, WI (US) 53593

( * ) Notice: Subject to any disclaimer, the term of this patent is extended or adjusted under 35 U.S.C. 154(b) by 0 days.

(21) Appl. No.: 10/268,189

(22) Filed: Oct. 10, 2002

(51) Int. Cl.[7] ..... A47G 1/16
(52) U.S. Cl. ..... 248/493; 248/339
(58) Field of Search ..... 248/493, 216.1, 248/217.1, 217.3, 218.3, 218.2, 217.4, 217.2, 684, 339, 231.9, 475.1, 489, 466, 222.52; 40/744, 745, 757, 617

(56) References Cited

U.S. PATENT DOCUMENTS 241,991 A * 5/1881 Jones
1,445,372 A * 2/1923 Wagner
1,616,957 A * 2/1927 Honigbaum
2,789,783 A * 4/1957 Jones
3,219,302 A * 11/1965 Smith
4,161,834 A * 7/1979 Hendricks, Jr. ..... 40/606
4,509,713 A * 4/1985 Hogg ..... 248/546
4,619,430 A * 10/1986 Hogg ..... 248/467
5,267,719 A * 12/1993 Keller ..... 248/493
6,474,608 B1 * 11/2002 Takata ..... 248/217.2

OTHER PUBLICATIONS

Heavy Duty Wall Hanger, Mel's Enterprises, Inc., http://www.heavydutywallhanger.com.

* cited by examiner

*Primary Examiner*—Gwendolyn Baxter
(74) *Attorney, Agent, or Firm*—Whyte Hirschboeck Dudek SC

(57) ABSTRACT

A device for hanging an object from a wall is disclosed. The device comprises a push plate, a lance, and a hanger. The push plate includes a front push plate surface and a back push plate surface opposing the front push plate surface. The lance extends from the front push plate surface and has a barb, which defines a barb surface, adjacent a distal end. The hanger extends from the front push plate surface. Also, the hanger is capable of receiving the object and biasing the barb surface against the wall when the object is received. At least one of the push plate and the hanger are capable of receiving a rotational force such that the hanger is positioned to receive the object. The device is capable of digital insertion into the wall. Therefore, the device can be employed to hang the object without the use of a mechanical tool.

21 Claims, 4 Drawing Sheets

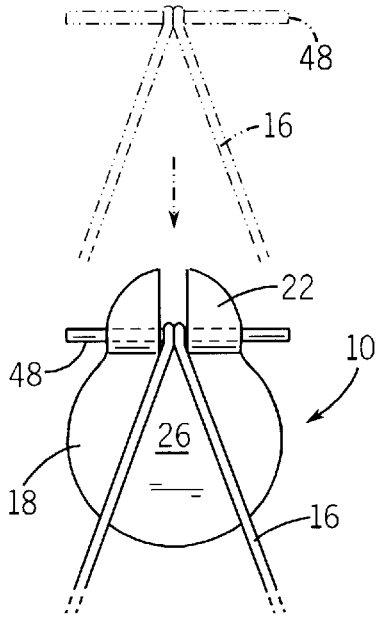
FIG. 8
FIG. 9
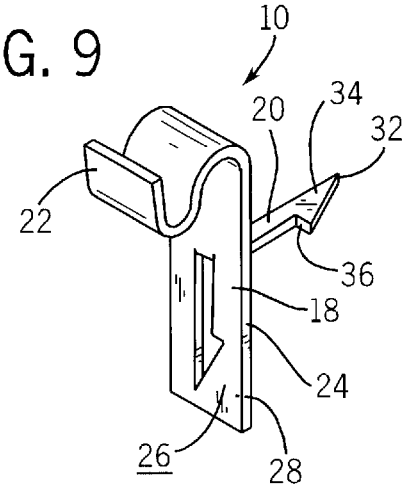
FIG. 10
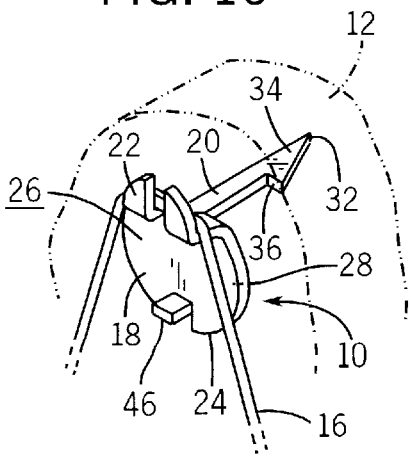
FIG. 11
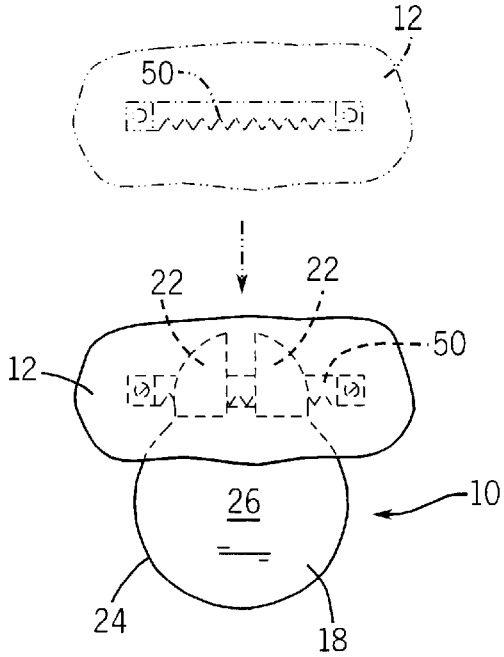

FIG. 12
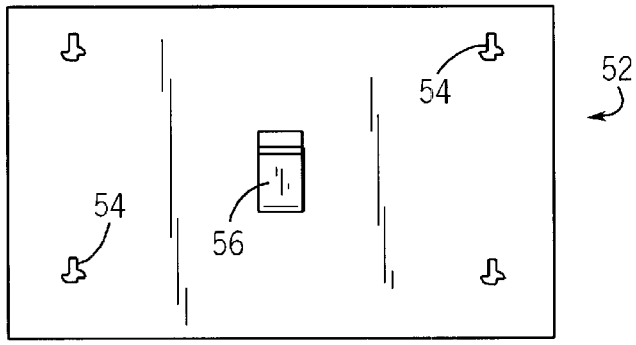
FIG. 13
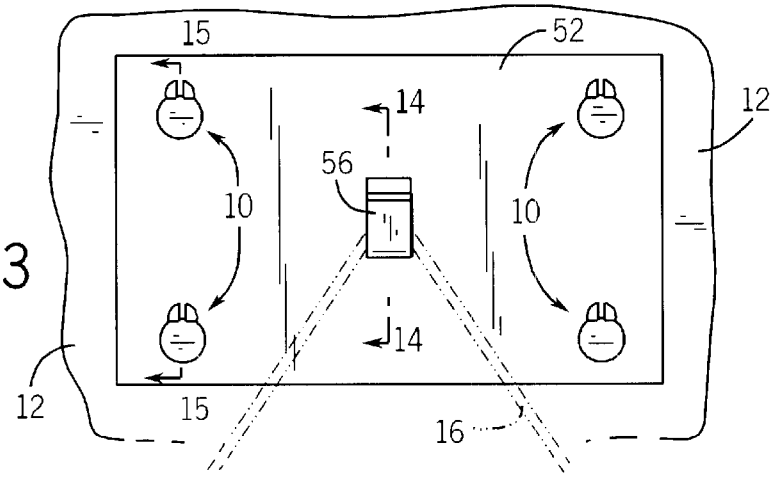
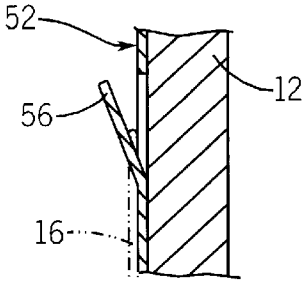
FIG. 14
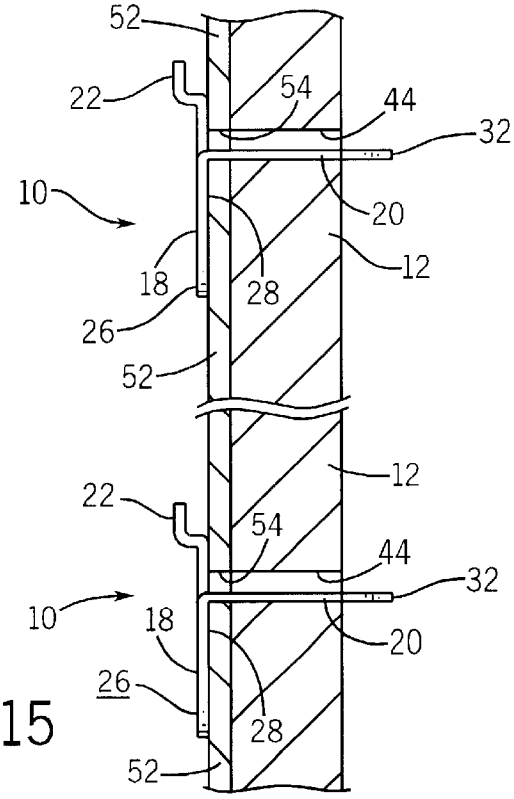
FIG. 15

TOOL-FREE HANGING DEVICE

BACKGROUND OF THE INVENTION

1. Field of the Invention

The present invention generally relates to a device for hanging an object on a wall. In one aspect, the invention relates to a device capable of hanging an object on a wall when the device is inserted in the wall and rotated without the use of a tool.

2. Description of the Related Art.

A typical device for hanging (e.g., supporting, suspending, etc.) an object (e.g., a picture) to a wall or similar surface includes a hanger structure and a means for supporting the hanger structure (e.g., a nail, a screw, etc.). Unfortunately, use of the typical hanging device often mandates the completion of several tasks. For example, a stud, which can accommodate the eventual insertion of the nail, must be located within the wall. Location of the stud can be accomplished by using a trial and error method comprising "tapping" various locations on the wall and listening for a "non-hollow" or "non-reverberating" sound indicating the presence of a stud. A trial and error method comprising poking numerous "test holes" in the wall can also be used. Alternatively, special tools (e.g., a stud finder, etc.) can be purchased and employed to find the stud.

Even after the stud is found, a pilot hole, which passes through the wall and into the stud, is often needed to promote acceptance of the nail into the stud. The pilot hole may also be necessary to inhibit and/or prevent damage to the stud and the wall. If opted for, the pilot hole can be generated with a mechanical tool (e.g., a drill, a screwdriver, the drill, etc.).

After finding and preparing the stud within the wall, the hanging device is readied by inserting the nail into an aperture within the hanger structure. This can prove to be a difficult task since an installer of the hanging device often attempts to simultaneously manage the mechanical tool (e.g., a hammer, etc.), the object to be hung, the hanger structure, and the nail.

When the nail has been coupled with the hanger structure, the hanging device is aligned with the stud, aligned with the pilot hole, or otherwise positioned relative to the wall. Upon achieving the desired position, the installer uses the mechanical tool to, for example, repeatedly strike and drive the nail into the wall. It is expected that, after driving the nail into the wall, the hanging device is well secured to and within the wall. However, since the nail often predominantly relies on friction generated between the nail and the wall to prevent withdrawal, release, and/or failure of the nail, securement of the hanging device in the wall can be precarious and tentative. Even so, the object is generally positioned onto the hanger structure such that the object hangs from the wall.

In other circumstances, hanging devices are known to include spreading members such as "pop-out" wings, extensible flaps, and the like (collectively "wings"). These wings are structured to expand after a hanging device has been inserted into a wall. While such hanging devices may not wholly rely on friction, the hanging devices often require the use of one or more mechanical tools. The mechanical tools are needed, for example, to drill a pilot hole into the wall for insertion of the hanging device, to drive the hanging device into the wall, and to expand the wings of the hanging device after the hanging device has been inserted into the wall. In addition to the frequent reliance such hanging devices have on mechanical tools, these hanging devices are typically not easily removed from the walls after insertion due to the expanded wings. During any removal, the expanded wings can cause significant damage to the walls.

Unfortunately, the conventional hanging device undesirably requires the use of a mechanical tool and/or substantially relies on friction. Thus, a device for hanging an object on a wall capable of insertion without the need for a mechanical tool would be desirable. Likewise, a device for hanging an object on a wall not completely relying on the force of friction to secure the hanging device would also be desirable.

SUMMARY OF THE INVENTION

In one aspect, the invention provides a device for hanging an object from a wall. The device comprises a push, plate, a lance, and a hanger. The push plate has a front push plate surface and a back push plate surface opposing the front push plate surface. The lance projects from the back push plate surface of the push plate and includes a barb adjacent a distal end. The barb includes a barb surface. The hanger extends from the push plate and projects from the front push plate surface of the push plate. The hanger is capable of receiving the object and biasing the barb surface against the wall when the object is received. As such, at least one of the push plate and the hanger are capable of receiving a rotational force that positions the hanger to receive the object.

In another embodiment, a device for hanging an object on a wall is disclosed. The device comprises a push plate, a lance, and a hanger. The push plate has a front push plate surface and a back push plate surface opposing the front push plate surface. The front push plate surface is configured to receive a pushing force from a digit. The lance projects from, and is substantially perpendicular to, the back push plate surface of the push plate. The lance includes a barb adjacent a distal end. The barb includes a barb surface and that is substantially parallel to the back push plate surface. The hanger extends from the push plate and projects from the front push plate surface of the push plate. The hanger is capable of receiving the object and biasing the barb surface against the wall when the object is received. As such, at least one of the push plate and the hanger are capable of receiving a rotational force that positions the hanger to receive the object.

In another aspect, the invention provides a method for hanging an object on a wall. The method comprises providing a hanging device having a push plate, a lance projecting from the push plate, and a hanger extending and projecting from the push plate. The lance has a barb adjacent a distal end and the barb includes a barb surface. The lance of the hanging device is inserted into the wall by pressing on the push plate and the hanging device is rotated until the hanger is positioned to receive the object. The object is then deposited on the hanger, and the barb surface biased against the wall, such that the hanging device hangs the object on the wall.

In yet another aspect, the invention provides a system for hanging an object on a wall. The system comprises at least two hanging devices and a plate having a plate hanger and at least two plate apertures. Each of the hanging devices includes a push plate having a front push plate surface and a back push plate surface opposing the front push plate surface, a lance projecting from the front push plate surface of the push plate, and a hanger extending from the push plate and projecting from the front push plate surface of the push plate. The lance has a barb adjacent a distal end. The barb includes a barb surface. The hanger is capable of receiving the object and biasing the barb surface against the wall when the object is received. The plate includes a plate hanger and at least two plate apertures. The plate hanger is capable of receiving the object and biasing the barb surface of each of the hanging devices against the wall when the object is received on the plate hanger. Each of the plate apertures is capable of receiving one of the at least two hanging devices. As such, at least one of the push plate and the hanger are capable of receiving a rotational force that positions the hanger of each of the devices to receive the object, the lance of each of the hanging devices is digitally inserted through one of the apertures and into the wall, and the object is hung on at least one of the plate hanger and the hanger.

BRIEF DESCRIPTION OF THE DRAWINGS

Embodiments of the invention are disclosed with reference to the accompanying drawings and are for illustrative purposes only. The invention is not limited in its application to the details of construction, or the arrangement of the components, illustrated in the drawings. The invention is capable of other embodiments or of being practiced or carried out in other various ways. Like reference numerals are used to indicate like components.

FIG. 8 is a front view of the hanging device of FIG. 6 engaging a rod and a wire typically connected to, or used in conjunction with, an object that is hung.

FIG. 9 is a perspective view of another embodiment of a hanging device having an ear hanger in accordance with one aspect of the present invention.

FIG. 10 is a perspective view of another embodiment of a hanging device having a salient in accordance with aspect of the present invention.

FIG. 11 is a view of the hanging device of FIG. 6 engaging a bracket.

FIG. 12 is a front view of a plate that can be employed with the hanging devices of FIGS. 1,6, and 9.

FIG. 13 is a front view of the hanging device of FIG. 6 employed within the plate of FIG. 12.

FIG. 14 is a croos-sectional view, taken along line 14—14, of the plate of FIG. 13.

FIG. 15 is a cross-sectional view, taken along line 15—15, of the plate of FIG. 13 employing the hanging devices of FIG. 6.

DETAILED DESCRIPTION OF THE PREFERRED EMBODIMENTS

Figure 1:
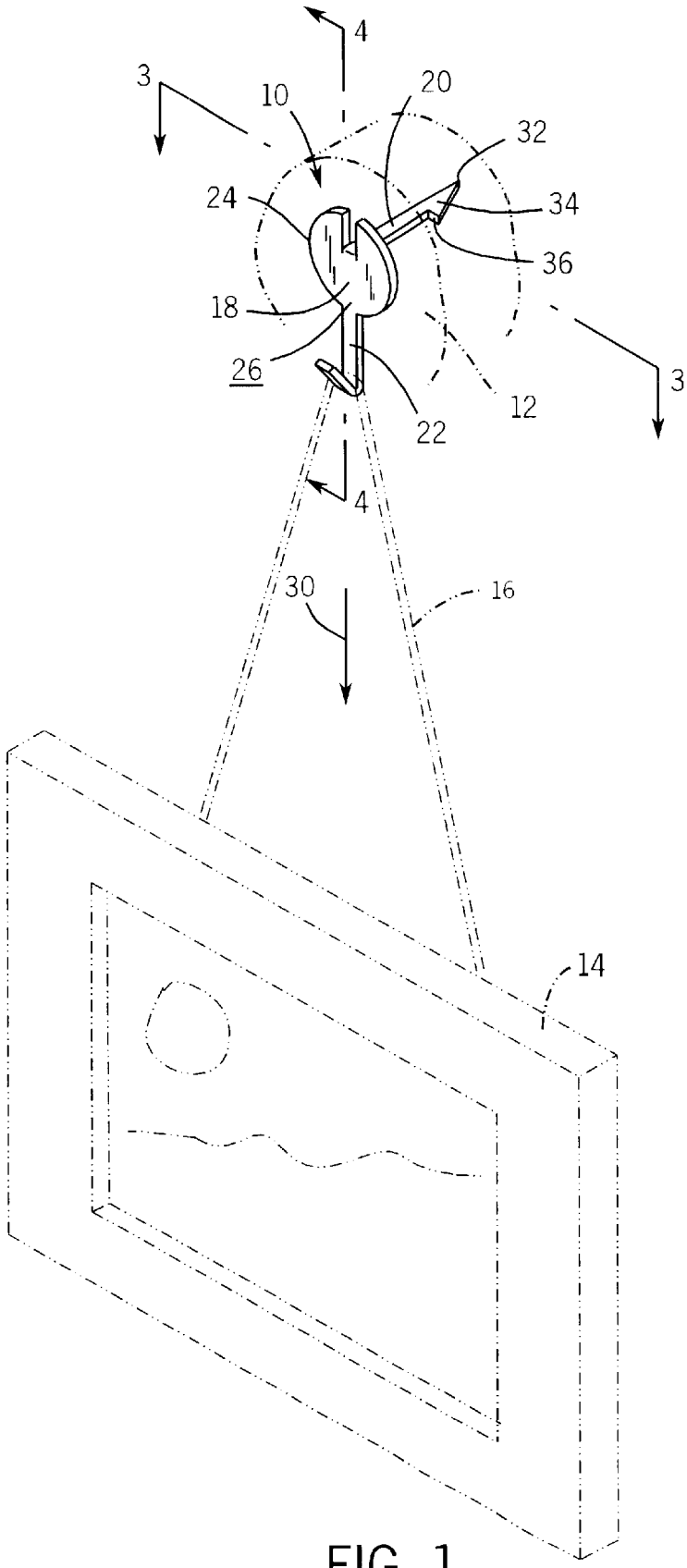
FIG. 1 is a perspective view of one embodiment of a hanging device in accordance with one aspect of the present invention.

Referring to FIG. 1, hanging device 10 is shown disposed in wall 12 and bearing an object 14 (e.g., a picture) that includes wire 16. To permit clear illustration of hanging device 10, each of wall 12, object 14, and wire 16 is shown in phantom. As collectively illustrated in FIGS. 1–4, hanging device 10 generally comprises push plate 18, lance 20, and hanger 22.

Figure 2:
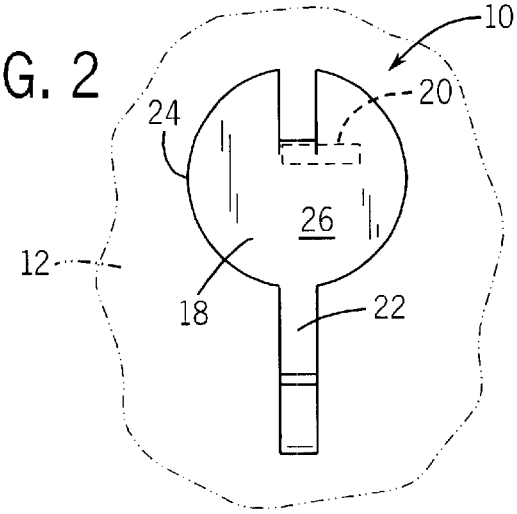
FIG. 2 is a front view of the hanging device of FIG. 1.
Figure 3:
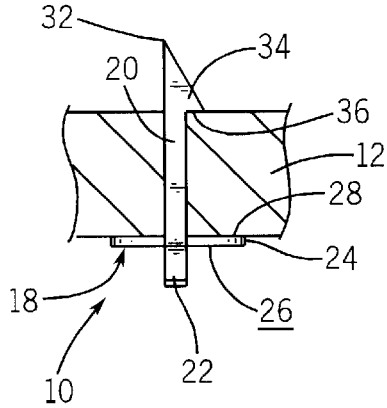
FIG. 3 is a cross-sectional view, taken along line 3—3, of the hanging device of FIG. 1.
Figure 4:
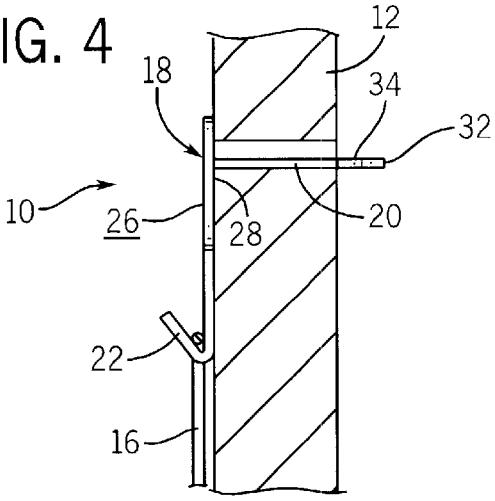
FIG. 4 croos-sectional view, taken along line 4—4, of the hanging device of FIG. 1.

As shown in FIG. 2, push plate 18 includes periphery 24 and Front push plate surface 26. Periphery 24 can be substantially circular, square, rectangular, triangular, elliptical, and the like. Front push plate surface 26 is structured to receive a pressing force from one or more digits (i.e., fingers). Each of front push plate surface 26 and periphery 24 are structured to receive a rotational force from the one or more digits. Therefore, push plate 18 is capable of experiencing both pushing and rotational forces. In a preferred embodiment, a cushioning material (not shown) can be applied to front push plate surface 26. Such a cushioning material (e.g., a layer of silicone, cloth, etc.) can provide comfort to the digits of an individual supplying the pressing and/or rotational force to push plate 18. As shown in FIGS. 3 and 4, push plate 18 also includes back push plate surface 28. Back push plate surface 28 generally opposes front push plate surface 26 (FIG. 2).

Preferably, when push plate 18 receives the rotational force, hanging device 10 is maneuvered into in an "object hanging position" as shown in FIG. 1. When hanging device 10 is in the object hanging position, hanger 22 is capable of receiving, suspending, and/or hanging (collectively "hanging") object 14. In the object hanging position, hanger 22 can benefit from a downward pull of gravity, as shown by gravitational arrow 30 in FIG. 1, that acts on object 14 to bias the object upon or towards the hanger.

Lance 20, as shown in FIGS. 1–4, projects from back push plate surface 28. Therefore, lance 20 extends outwardly from push plate 18. In a preferred embodiment, lance 20 is substantially perpendicular to back push plate surface 28. Lance 20 includes distal end 32 and barb 34 disposed adjacent and/or proximate the distal end. As shown in FIGS. 1 and 3, barb 34 defines barb surface 36. In a preferred embodiment, barb surface 36 is substantially parallel to back push plate surface 28.

Although FIG. 1 depicts lance 20 having only a single barb (e.g., barb 34), more than one barb can be disposed proximate distal end 32 of lance 20 if desired. If a plurality of barbs 34 are placed on lance 20, the barbs can be co-planar, perpendicular to each other, stacked upon each other, and the like.

Hanger 22, as shown in FIGS. 1–4, projects from front push plate surface 26. Therefore, hanger 22 extends outwardly from push plate 18. Hanger 22 preferably extends from push plate 18 in a direction opposite the outward extension of lance 20. Hanger 22 is structured to hang object 14. When the object 14 is hung as illustrated in FIG. 1, hanger 22 resultantly biases barb surface 36 against wall 12 as shown in FIGS. 3 and 4.

Hanger 22 is also structured to receive the rotational force such that the hanging device can be placed in the hanging position as described above and shown in FIG. 1. In a preferred embodiment, at least a portion of hanger 22 and lance 20 are substantially perpendicular to each other.

Figure 5:
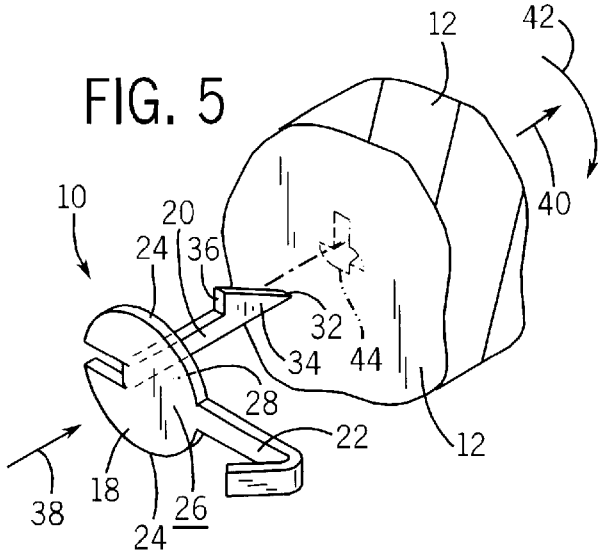
FIG. 5 is a perspective view of the hanging device of FIG. 1 illustrating insertion and rotation of the hanging device in and into a wall in accordance with one aspect of the present invention.

In operation, hanging device 10 is first positioned into a "device insertion position" as shown in FIG. 5. After hanging device 10 has achieved the device insertion position, lance 20 is advanced towards wall 12 by virtue of the pressing force, as shown by pressing force arrow 38, acting upon at least one of front push plate surface 26, periphery 24, and elsewhere on hanging device 10. The pressing force is digitally supplied to and/or exerted upon push plate surface 26, periphery 24, and hanging device 10 (i.e., provided by one or more fingers). Therefore, insertion of lance 20 is performed without reliance upon, or use of, any of the mechanical tools.

As application of the pressing force continues, lance 20 is inserted into wall 12 as shown by insertion arrow 40. Preferably, lance 20 is inserted into wall 12 until barb 34 passes entirely through the wall and back push plate surface 28 abuts the wall as illustrated in FIG. 3.

After insertion into wall 12, hanging device 10 is subjected to the rotational force as shown by rotation arrow 42 in FIG. 5. The rotational force can be applied to, for example, at least one of hanger 22 or periphery 24 as convenient. The rotational force is digitally supplied to and/or exerted upon hanger 22, periphery 24, and hanging device 10 (i.e., provided by one or more fingers). Therefore, rotation of hanging device 10, including lance 20, can be performed without reliance upon, or use of, any of the mechanical tools.

Hanging device 10 is rotated (i.e., turned, spun, etc.), until the hanging device has attained the object hanging position depicted in FIG. 1. In a preferred embodiment, hanging device 10 is rotated at least about ninety degrees in a direction and orientation consistent with, for example, rotation arrow 42 in FIG. 5. As such, hanging device can be advanced from the device insertion position (FIG. 5) to the object hanging position (FIG. 1). After rotation into the object hanging position, hanger 22 is now oriented to receive object 14.

During insertion and rotation of lance 20, lance aperture 44 is created in wall 12 as illustrated in FIG. 5. Lance aperture 44 is formed, in part, when lance 20 and barb 34 are inserted into wall 12. Formation of lance aperture 44 is completed when lance 20 is rotated within wall 12. Because lance aperture 44 is produced in such a manner, the lance aperture does not excessively deteriorate and/or destroy a significant portion of wall 12.

Once hanger 22 has been positioned to receive object 14, the object (including wire 16) can be lowered and/or moved onto the hanger. When object 14 is lowered, hanger 22 engages with the object. After this initial engagement, object 14 (or wire 16) can be deposited on, around, and/or over the hanger by releasing the object. After deposition, object 14 is allowed to dangle or be suspended from hanger 22 as the hanger securely grasps the object. Object 14 has now been steadfastly positioned, for example upon wall 12, such that the object can be viewed, used, and the like. In other words, object 14 is now considered "hung" by hanger 22, and in general by hanging device 10, as shown in FIG. 1. One effect or result that is produced by hanging object 14 upon hanger 22 relates or corresponds to barb surface 36. When object 14 is deposited on hanger 22, the hanger is pulled or biased downwardly by gravity as shown by gravitational arrow 30 in FIG. 1. The downward pull on hanger 22 translates through hanging device 10 to barb surface 36 (FIG. 3) such that the barb surface, as shown in FIG. 3, is biased against wall 12. As such, barb surface 36 holds, restrains, and/or secures hanging device 10 within or to wall 12. In other words, hanging device 10 utilizes wall 12 to impede barb surface 36 and to prevent barb 34 from undesirably passing through the wall.

Since hanging device 10 uses engagement of, and contact between, wall 12 and barb surface 36, the hanging device is not wholly reliant on friction generated between the wall and lance 20 to maintain the hanging device within the wall. Thus, hanging device 10 can be more securely and, if desired, permanently affixed to wall 12.

While hanging device 10 can be permanently secured to wall 12, removal of hanging device 10 from wall 12 can be easily accomplished if needed or desired. To extract hanging device 10 from wall 12, the hanging device is simply rotated in a direction opposite the direction used to insert the hanging device. The rotation in the opposite direction is continued until barb 34 on lance 20 is aligned with that portion of lance aperture 44 in wall 12 that mimics the barb. In other words, hanging device 10 is rotated from the object hanging position, as shown in FIG. 1, back to the device insertion position as shown in FIG. 5. Thereafter, the device is extracted from wall 12 by pulling lance 20 and barb 34 through lance aperture 44. Thus, hanging device 10 can be used and reused as convenient.

Figure 6:
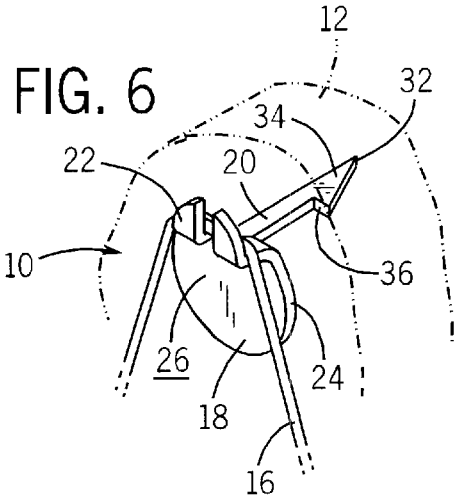
FIG. 6 is a perspective view of another embodiment of a hanging device having a notched-ear hanger in accordance with one aspect of the present invention.
Figure 7:
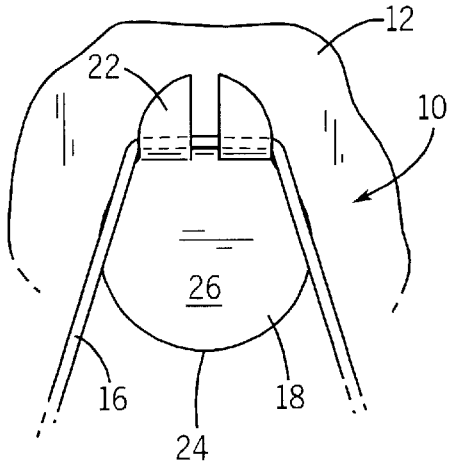
FIG. 7 is front view of the hanging device of FIG. 6.

Although hanging device 10, as shown in FIG. 1, employs a "hook" hanger (i.e., the hanger is fashioned to resemble a "hook"), a multitude of variously configured hangers can be used. For example, as illustrated in FIGS. 6–8 in a preferred embodiment, a "notched ear" hanger 22 can be employed. In another preferred embodiment, as depicted in FIG. 9, an "ear" hanger 22 can be constructed and utilized. It is contemplated that hanger 22, as well as hanging device 10, can assume a variety of shapes and sizes and still appropriately function to receive, secure, and/or hang object 14.

In one embodiment, as shown in FIG. 10, salient 46 (i.e., lip, knob, etc.) is provided on push plate 18 and projects from front push plate surface 26. Salient 46 is structured to receive the rotational force as described above. Therefore, salient 46 can be provided on push plate 18 and a rotational force exerted on the salient to perform the rotation of hanging device 10. As such, salient 46 can move or assist in moving hanging device 10 from the device insertion position into the object hanging position (FIG. 1).

As collectively shown in FIGS. 8, 10, and 11, hanger 22 is structured to be engageable with wire 16 (FIG. 10), a combination of wire 16 and rod 48 (FIG. 8), or bracket 50 (FIG. 11). Although not shown, it is contemplated that various brackets like or equivalent to bracket 50, as well known in the art, can engage with or be received by hanger 22. As such, hanger 22 is adaptable to be used with a variety of methods and systems for hanging objects.

Plate 52, as illustrated in FIG. 12, comprises a plurality of plate apertures 54 and plate hanger 56. Plate 52 is configured for use with a plurality of hanging devices 10 as shown in FIG. 13. Plate 52 and the plurality of hanging devices 10 can be used in combination to, for example, support object 14 (FIG. 1) by wire 16 when the object is too heavy to be suspended by one of the hanging devices acting alone. In a preferred embodiment, as shown in FIG. 12, plate apertures 54 are substantially the same as or similar to lance apertures 44 that are illustrated in FIG. 5 and described above.

Plate hanger 56, as depicted in FIG. 13, is capable of receiving and securing object 14 and wire 16. Like hanger 22, plate hanger 56 can also resemble a "hook", an "ear", a "notched ear", and the like.

Referring to both FIGS. 12 and 13, each plate aperture 54 can receive one of a plurality of hanging devices 10. In other words, when plate 52 is used, lance 20 from one of hanging devices 10 mates with and passes through one of plate apertures 54. Then, as previously described, lance 20 is inserted into wall 12 and rotated. As a result, each hanging device 10 is disposed within one of plate apertures 54 and is secured to wall 12. Each hanging device 10 works with the other hanging devices to collectively secure plate 52 to wall 12.

When object 14 is received upon plate hanger 56, the plate hanger biases each barb surface 36 (FIG. 3) of each hanging device 10 against wall 12. As such, each barb surface 36 holds, restrains, and/or secures each hanging device 10, as well as plate 52, to and/or against wall 12. Therefore, plate 52 is maintained adjacent to wall 12 as shown in FIGS. 14 and 15. Thus, plate hanger 56 of plate 52 can receive and hang object 14.

If desired, several hanging devices 10 can be used in combination with plate hanger 56 to support object 14. For example, wire 16 can be deposited upon (i.e., draped over) one or more hangers 22 from hanging devices 10 as well as upon plate hanger 56 from plate 52. Advantages of such an embodiment can include increased support for object 14, the ability to level and/or adjust orientation of the object, and the like.

Although compatible with a variety of materials, hanging device 10 is particularly well-suited suited for walls 12 fashioned from drywall, plasterboard, and the like. Further, hanging device 10 can be constructed using various materials such as metals or metal alloys (e.g., stainless steel, aluminum, etc.) and plastics, polymers, or synthetic materials (e.g., lexan, nylon, carbonate, etc.).

While object 14 can be, for example, a picture as shown in FIG. 1, the object can also include a variety of other articles, decorations, and products that are conventionally hung upon or secured to walls 12. Such articles, decorations, and products are well known in the art.

In one embodiment, hanging device 10 can be produced such the hanging device comprises a unitary construction. In such cases, push plate 18 is properly referred to as a "push plate portion" of hanging device 10. Similarly, lance 20 and hanger 22 are also properly referred to as "lance portion" and "hanger portion", respectively. Also, hanging device 10 can be formed by stamping a selected material (e.g., steel) to form a die and then bending and/or cutting that die until a desired configuration for the hanging device is attained. Each feature of hanging device 10, such as hanger 22, lance 20, and salient 46, can be created by manipulating the die stamped from the single piece of material. As an alternative to bending and cutting the die, any one of several widely known and conventionally used molding processes can be selected to form hanging device 10.

Despite any methods being outlined in a step-by-step sequence, the completion of acts or steps in a particular chronological order is not mandatory. Further, elimination, modification, rearrangement, combination, reordering, or the like, of acts or steps is contemplated and considered within the scope of the description and appended claims.

Also, while the present invention has been described in terms of the preferred embodiment, it is recognized that equivalents, alternatives, and modifications, aside from those expressly stated, are possible and within the scope of the description and appended claims.

What is claimed is:

1. A device for hanging an object from a wall, the device comprising:

a push plate having a front push plate surface and a back push plate surface opposing the front push plate surface;

a lance projecting from the back push plate surface of the push plate the lance having a barb adjacent a distal end, the barb including a barb surface; and a hanger extending from the push plate and projecting from the front push plate surface of the push plate, the hanger capable of receiving the object and biasing the barb surface against the wall when the object is received:

wherein the push plate the hanger are capable of receiving a rotational force that positions the hanger to receive the object: and wherein a salient extends from the front push plate surface of the push plate, the salient capable of receiving a rotational force.

2. The device of claim 1, wherein the hanger is one of a hook hanger, an ear hanger, and a notched ear hanger.

3. The device of claim 1, wherein the hanger is engageable with one of a wire, a wire and a rod and a bracket.

4. The device of claim 1, wherein the device is of a unitary construction.

5. The device of claim 1, wherein the device is constructed of one of a plastic, a metal, and a metal alloy.

6. The device of claim 1, wherein the front push plate surface is configured to receive pushing force from a digit.

7. The device of claim 1, wherein the lance is substantially perpendicular to the back push plate surface.

8. The device of claim 1, wherein the barb surface is substantially parallel to the back push plate surface.

9. The method of claim 1, wherein the hanging device is inserted into the wall without using a mechanical tool.

10. A device for hanging an object on a wall, the device comprising:

a push plate having a front push plate surface and a back push plate surface opposing the front push plate surface the front push plate surface configured to receive a pushing force from a digit;

a lance projecting from and substantially perpendicular to, the back push plate surface of the push plate, the lance having a barb adjacent a distal end, the barb including a barb surface, the barb surface substantially parallel to the back push plate surface; and a hanger extending from the push plate and projecting from the front push plate surface of the push plate, the hanger capable of receiving the object and biasing the barb surface against the wall when the object is received;

wherein the push plate and the hanger are capable of receiving a rotational force that positions the hanger to receive the object; and wherein a salient extends from the front push pate surface of the push plate the salient capable of receiving a rotational force.

11. A method for hanging an object on a wall the method comprising:

providing a hanging device having a push plate, a lance projecting from the push plate, the lance having a barb adjacent a distal end, the barb including a barb surface and a hanger extending and projecting from the push plate;

inserting the lance of the hanging device into the wall by pressing on the push plate:

rotating the hanging device until the hanger is positioned to receive the object;

depositing the object on the hanger and biasing the barb surface against the wall such that the banding device hands the object on the wall; and providing a salient on the push plate and exerting a rotational force on the salient to perform the rotating step.

12. The method of claim 11, wherein the inserting step is performed using a digit.

13. The method of claim 11, wherein the inserting step is performed without using a mechanical tool.

14. The method of claim 11, wherein the rotating step is performed by exerting a rotational force on the hanger.

15. The method of claim 11, wherein the rotating step is performed by exerting a rotational force on the push plate.

16. The method of claim 11, wherein the hanging device is rotated at least about ninety degrees during the rotating step.

17. The method of claim 11, wherein the insertion step is performed until the push plate abuts the wall.

18. The method of claim 11, wherein the method further comprises biasing the barb surface against the wall during the hanging step.

19. The method of claim 11, wherein the method further comprises maneuvering the hanging device into device insertion position.

20. The method of claim 11, wherein the rotating step continues until the hanging device achieves an object hanging position.

21. A system for hanging i object on a wall, the system comprising:

at least two hanging devices each of the hanging devices including a push plate having a front push plate surface and a back push plate surface opposing the front push plate surface, a lance projecting from the front push plate surface the push plate, the lance having a barb adjacent a distal end, the barb including a barb surface, and a hanger extending from the push plate and projecting from the front push plate surface of the push plate, the hanger capable of receiving the object and biasing the barb surface against the wall when the object is received; and a plate having a plate hanger and at least two plate apertures, the plate hanger capable of receiving the object and biasing the barb surface of each of the hanging devices against the wall when the object is received on the plate hanger,each of the plate apertures capable of receiving one of the at least two hanging devices;

wherein at least one of the push plate and the hanger are capable of receiving a rotational force that positions the hanger of each of the de receive the object, the lance of each of the hanging devices is digitally inserted through one of the apertures and into the wall, and the object is hung on at least one of the plate hanger and the hanger.

* * * * *

UNITED STATES PATENT AND TRADEMARK OFFICE

CERTIFICATE OF CORRECTION

PATENT NO. : 6,641,107 B1
DATED : November 4, 2003
INVENTOR(S) : Peter G. Janssen It is certified that error appears in the above-identified patent and that said Letters Patent is hereby corrected as shown below:

Column 8,
Line 1, insert -- and -- between “plate” and “the”.
Line 16, insert -- a -- between “receive” and “pushing”.
Line 41, replace “pate” with -- plate --.
Line 56, replace “banding” with -- hanging --.
Line 57, replace “hands” with -- hangs --.

Column 9,
Line 17, replace “i” with -- an --.

Column 10,
Line 1, insert -- of -- between “surface” and “the”.
Line 17, replace “de” with -- devices to --.

Signed and Sealed this

Twentieth Day of April, 2004

JON W. DUDAS
*Acting Director of the United States Patent and Trademark Office*